US010281865B2

(12) United States Patent
Hattori et al.

(10) Patent No.: US 10,281,865 B2
(45) Date of Patent: May 7, 2019

(54) SHEET CONTAINING SYSTEM AND IMAGE FORMING APPARATUS

(71) Applicant: FUJI XEROX Co., Ltd., Tokyo (JP)

(72) Inventors: Ryuji Hattori, Kanagawa (JP); Yosuke Ninomiya, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/946,009

(22) Filed: Apr. 5, 2018

(65) Prior Publication Data

US 2019/0072891 A1 Mar. 7, 2019

(30) Foreign Application Priority Data

Sep. 7, 2017 (JP) ..... 2017-172103

(51) Int. Cl.
*G03G 15/00* (2006.01)
*B65H 3/06* (2006.01)
*G03G 15/08* (2006.01)

(52) U.S. Cl.
CPC ..... *G03G 15/6511* (2013.01); *B65H 3/0638* (2013.01); *G03G 15/0805* (2013.01)

(58) Field of Classification Search
CPC ..... G03G 15/6502; G03G 15/6511; G03G 2215/00383; G03G 15/0805; B65H 1/26; B65H 1/266; B65H 3/0638
See application file for complete search history.

(56) References Cited

U.S. PATENT DOCUMENTS 4,605,215 A * 8/1986 Hyltoft ..... G03G 15/6511 271/10.04
6,055,407 A * 4/2000 Inoue ..... G03G 15/6511 271/119
8,923,712 B1 12/2014 Kiuchi et al.
9,195,167 B2 11/2015 Kiuchi et al.
9,411,263 B2 8/2016 Kiuchi et al.
9,696,680 B2 7/2017 Kawasaki et al.
2006/0180998 A1* 8/2006 Lee ..... B65H 1/266 271/171
2016/0320719 A1 11/2016 Kiuchi et al.
2016/0320736 A1 11/2016 Kiuchi et al.
2017/0192728 A1 7/2017 Someya

FOREIGN PATENT DOCUMENTS

JP 2015-011047 A 1/2015
JP 2016-008978 A 1/2016
JP 2016-113253 A 6/2016
(Continued)

*Primary Examiner* — Sophia S Chen
(74) *Attorney, Agent, or Firm* — Sughrue Mion, PLLC

(57) ABSTRACT

A sheet containing system includes a containing member, a feed device, an ascending device, and a powder applying device. The containing member has a wall portion and is to contain a sheet. The feed device feeds the sheet to an outside of the containing member. The ascending device moves up the sheet contained in the containing member toward the feed device. The powder applying device is provided in the wall portion disposed on a downstream side in the containing member in a transport direction of the sheet. The powder applying device applies powder to an end portion of the sheet on the downstream side in the transport direction of the sheet.

12 Claims, 7 Drawing Sheets

(56) References Cited

FOREIGN PATENT DOCUMENTS

| | | | |
|---|---|---|---|
| JP | 2016-132466 | A | 7/2016 |
| JP | 2016-133564 | A | 7/2016 |
| JP | 2016-133565 | A | 7/2016 |
| JP | 2016-161853 | A | 9/2016 |
| JP | 2016-181103 | A | 10/2016 |

* cited by examiner

SHEET CONTAINING SYSTEM AND IMAGE FORMING APPARATUS

CROSS-REFERENCE TO RELATED APPLICATIONS

This application is based on and claims priority under 35 USC 119 from Japanese Patent Application No. 2017-172103 filed Sep. 7, 2017.

BACKGROUND

Technical Field

The present invention relates to a sheet containing system and an image forming apparatus.

SUMMARY

According to an aspect of the present invention, a sheet containing system includes a containing member, a feed device, an ascending device, and a powder applying device. The containing member has a wall portion and is to contain a sheet. The feed device feeds the sheet to an outside of the containing member. The ascending device moves up the sheet contained in the containing member toward the feed device. The powder applying device is provided in the wall portion disposed on a downstream side in the containing member in a transport direction of the sheet. The powder applying device applies powder to an end portion of the sheet on the downstream side in the transport direction of the sheet.

BRIEF DESCRIPTION OF THE DRAWINGS

Exemplary embodiments of the present invention will be described in detail based on the following figures, wherein.

DETAILED DESCRIPTION

First Exemplary Embodiment

A sheet containing system and an image forming apparatus according to a first exemplary embodiment are described.

Overall Structure

Figure 1:
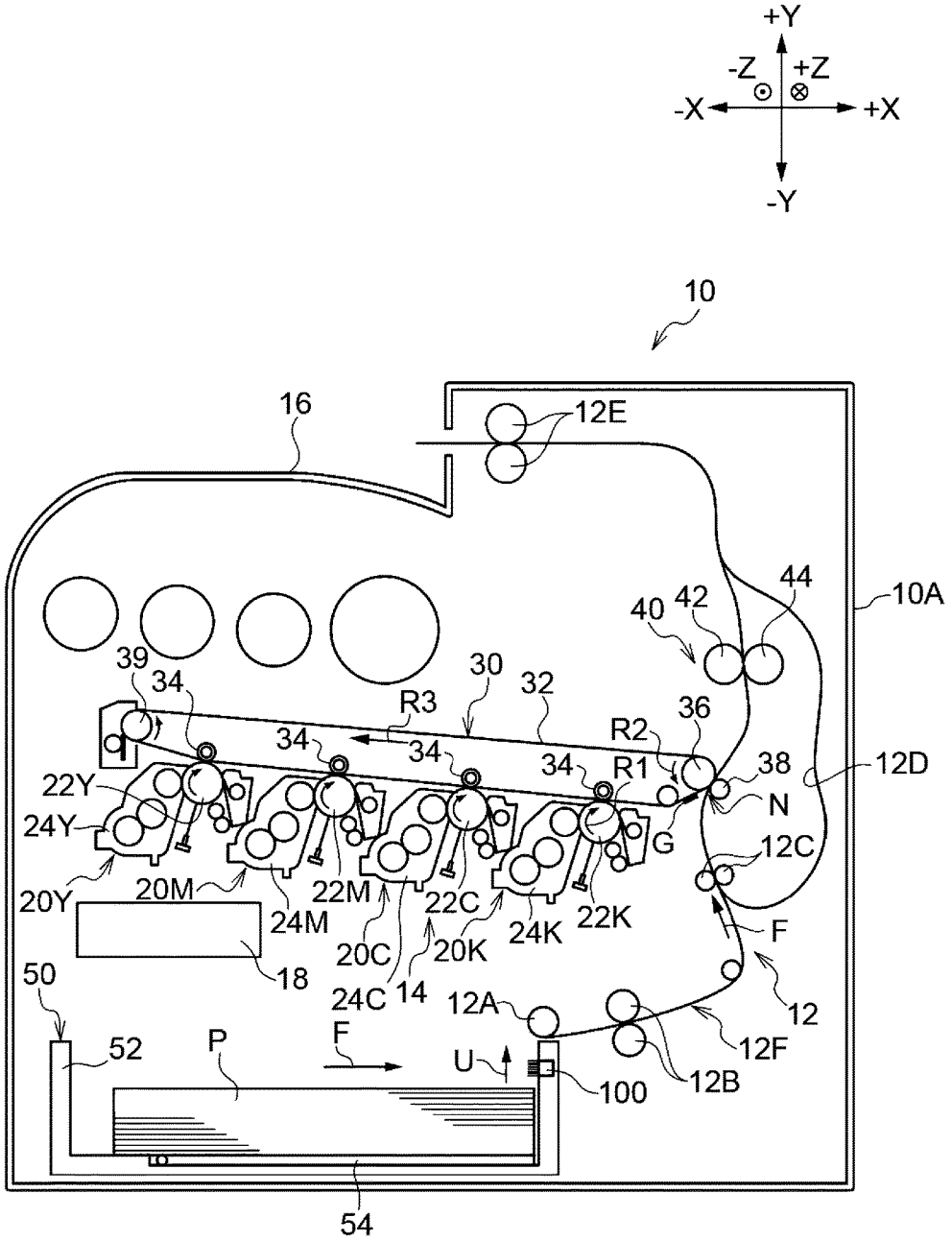
FIG. 1 is a structural view (front view) of an image forming apparatus according to a first exemplary embodiment.

FIG. 1 illustrates an image forming apparatus 10 that includes a containing unit 50 serving as an example of the sheet containing system according to the present exemplary embodiment. In the following description, in front view of the image forming apparatus 10, the apparatus width direction, the apparatus height direction, and the apparatus depth direction are respectively referred to as the X direction, the Y direction, and the Z direction. Furthermore, when it is required that one side and the other side are distinguished from each other in each of the X direction, the Y direction, and the Z direction, in front view of the image forming apparatus 10, the upper side is referred to as the +Y side, the lower side is referred to as the −Y side, the right side is referred to as the +X side, the left side is referred to as the −X side, the rear side is referred to as the +Z side, the front side is referred to as the −Z side.

The image forming apparatus 10 includes the transport unit 12, an image forming section 14, and a fixing device 40. The transport unit 12 transports sheets of recording paper. Each of these recording sheets serves as an example of a recording medium. The image forming section 14 forms with toner toner images G on the recording sheet transported by the transport unit 12. The fixing device 40 applies heat and pressure to the toner images G so as to fix the toner images G onto the recording sheet. According to the present exemplary embodiment, the toner images G are formed on label sheets of paper P. Each of these label sheets P serves as the recording medium instead of the recording sheet. The details of the label sheet P will be described later. The following description describes the case where the label sheet P is used as the recording medium.

As illustrated in FIG. 1, the image forming section 14 includes image forming units 20Y, 20M, 20C, and 20K and a transfer unit 30. Here, yellow (Y), magenta (M), cyan (C), and black (K) are examples of toner colors. Furthermore, the image forming section 14 includes a controller 18 that controls operation of components of the image forming units 20 to cause the toner images G to be formed on the label sheet P. The image forming units 20 perform charging, exposing, developing, and transfer steps of a known electrophotographic method as an example. In the following description, the suffixes Y, M, C, and K of the image forming units 20Y, 20M, 20C, and 20K and components included therein are omitted when distinction in accordance with the toner colors (Y, M, C, and K) is not required.

The image forming units 20 include respective photosensitive drums 22 and respective developing devices 24.

The photosensitive drums 22 have a function of holding the toner images G developed by the developing devices 24. Here, on outer circumferential surfaces of the photosensitive drums 22Y, 22M, 22C, and 22K, the toner images G of the respective colors, that is, yellow (Y), magenta (M), cyan (C), and the black (K) are formed. The photosensitive drums 22 each have a cylindrical shape and are each rotated about its own axis (in an arrow R1 direction) by a drive device (not illustrated). The photosensitive drum 22 includes, for example, an aluminum base material and a photosensitive layer (not illustrated). The photosensitive layer includes an undercoating layer, a charge production layer, and a charge transport layer formed in this order on the base material.

The developing devices 24 have a function of developing electrostatic latent images formed on the photosensitive drums 22 into the respective toner images G. The developing devices 24 each extends in the axial direction of the photosensitive drum 22.

The transfer unit 30 has a function of transferring through second transfer the toner images G of the respective colors onto the label sheet P after the toner images G that had been developed on the outer circumferential surfaces of the photosensitive drums 22 by the developing devices 24 have been transferred through first transfer. The transfer unit 30 includes a transfer belt 32, first transfer rollers 34 for the respective colors, a drive roller 36, and a second transfer roller 38. Here, the transfer belt 32 is an example of an image holding body that holds the toner images G.

The transfer belt 32 is an endless belt. The first transfer rollers 34 and the drive roller 36 are disposed so as to be in contact with an inner circumferential surface of the transfer belt 32. The orientation of the transfer belt 32, which is inclined relative to the apparatus width direction in front view, is determined by rollers in contact with the inner circumferential surface of the transfer belt 32, that is, the four first transfer rollers 34, the drive roller 36, a tension applying roller 39, and so forth. The outer circumferential surfaces of the photosensitive drums 22 of the image forming units 20 arranged in a direction inclined relative to the apparatus width direction are in contact with a portion of an outer circumferential surface of the transfer unit 30 facing the lower side in the apparatus height direction. As illustrated in FIG. 1, when the drive roller 36 is rotated in an arrow R2 direction, the transfer belt 32 is rotated in an arrow R3 direction.

A first transfer voltage is applied to the first transfer rollers 34, thereby transferring through first transfer the toner images G formed on the outer circumferential surfaces of the photosensitive drums 22Y, 22M, 22C, and 22K onto the outer circumferential surface of the transfer belt 32.

The second transfer roller 38 has an elongated shape. The second transfer roller 38 is pressed by a pressure device (not illustrated) during image forming operation, thereby a nip N is formed between the second transfer roller 38 and the transfer belt 32. A second transfer voltage is applied to the second transfer roller 38, thereby transferring through second transfer the toner images G having been transferred through first transfer onto the outer circumferential surface of the transfer belt 32 onto the label sheet P transported by the transport unit 12 and passing through the nip N.

The transport unit 12 has a function of transporting the label sheets P contained in the containing unit 50 toward an output unit 16. The transport unit 12 includes a feed roller 12A, a transport roller pair 12B, a transport roller pair 12C, an inversion transport unit 12D, and output rollers 12E. The label sheet P is transported in a transport direction F through a transport path 12F. In the containing unit 50 to be described later, a direction in which the label sheets P are moved from a containing member 52 to the feed roller 12A and the transport roller pair 12B, that is, toward the +X side is the transport direction F. Here, the feed roller 12A has a function of feeding each of the label sheets P contained in the containing unit 50 to the outside of the containing unit 50. The feed roller 12A serves as an example of a feed device.

The fixing device 40 has a function of fixing onto the label sheet P the toner images G transferred through second transfer onto the label sheet P. The fixing device 40 includes a fixing roller 42 and a pressure roller 44.

The Label Sheet

Figure 2A:
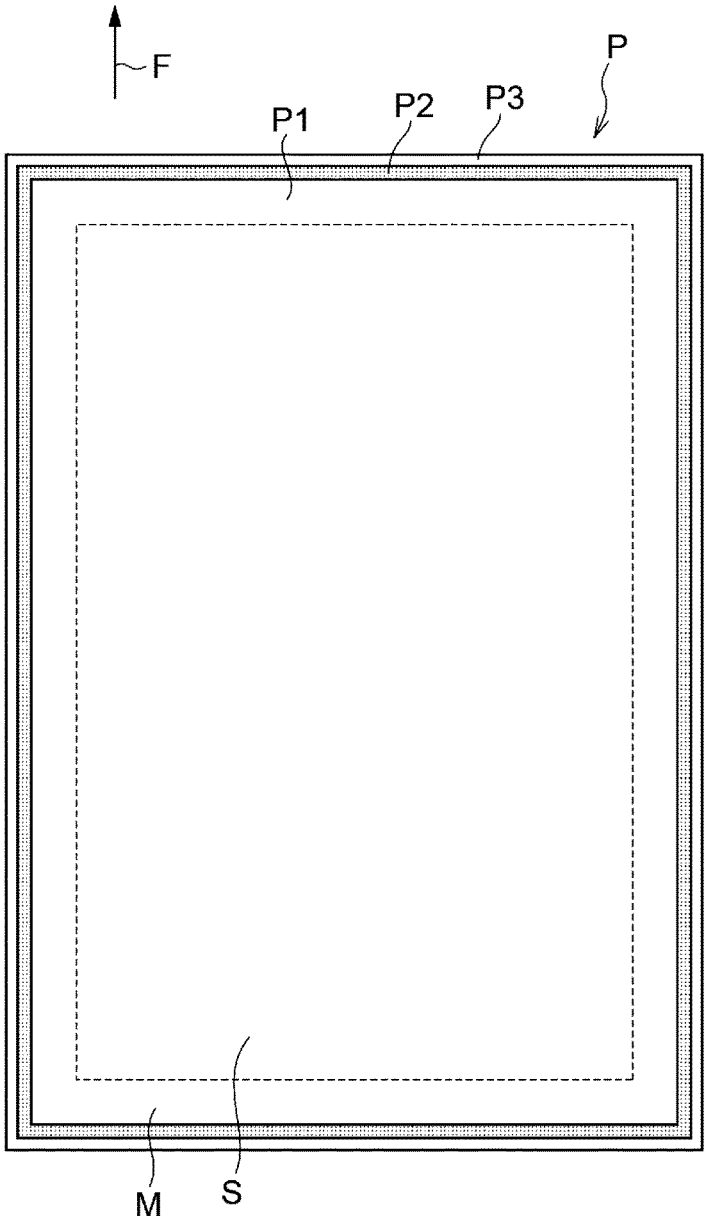
FIGS. 2A and 2B are respectively a plan view and a side view of a label sheet used with the image forming apparatus according to the first exemplary embodiment.
Figure 2B:
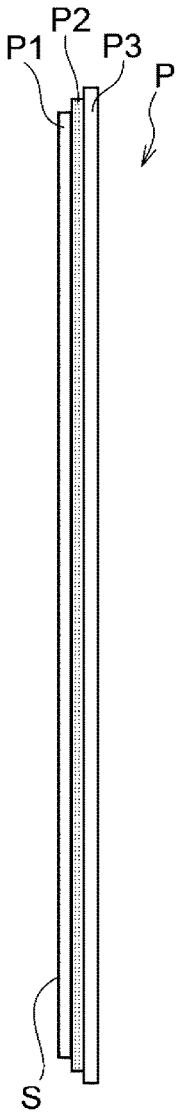

The image forming apparatus 10 according to the present exemplary embodiment is able to form images on the label sheet P serving as an example of the recording medium. As illustrated in FIGS. 2A and 2B, the label sheet P includes a surface material P1, a tacky layer P2, and release paper P3. The toner images G are transferred (images are formed) onto the surface of the surface material P1. The tacky layer P2 includes glue applied to a rear surface of the surface material P1. The release paper P3 is pasted on the tacky layer P2. Furthermore, a transfer surface S is set as a surface onto which the toner images G are transferred in the surface material P1 of the label sheet P. Furthermore, the transfer surface S has an image forming region A where the images are formed and margins M where no image is formed. Examples of the margins M include, for example, a region where the toner images G are not able to be transferred, a region where the quality of the images formed therein is not guaranteed, and a region set by the controller 18. The label sheet P is an example of a sheet. An end portion of the label sheet P on the downstream side in the transport direction F is defined as a leading end and an end portion of the label sheet P on the upstream side in the transport direction F is defined as a trailing end.

Here, the tacky layer P2 may extend outward past the surface material P1 to a surrounding region depending on the state of cutting of the label sheet P when the label sheet P is formed. Furthermore, the release paper P3 may be shifted relative to the surface material P1 due to warpage of the label sheet P during transportation. This may also cause the tacky layer P2 to extend outward past the surface material P1 to the surrounding region.

Examples of the surface material P1 include fine paper, kraft paper, recycled paper, and so forth. Examples of the glue applied to the tacky layer P2 include a variety of adhesives such as an acrylic adhesive, a polyester adhesive, a urethane adhesive, a silicone adhesive, a natural rubber adhesive, and a synthetic rubber adhesive.

Structures

Next, the containing unit 50 according to the present exemplary embodiment is described.

Figure 3A:
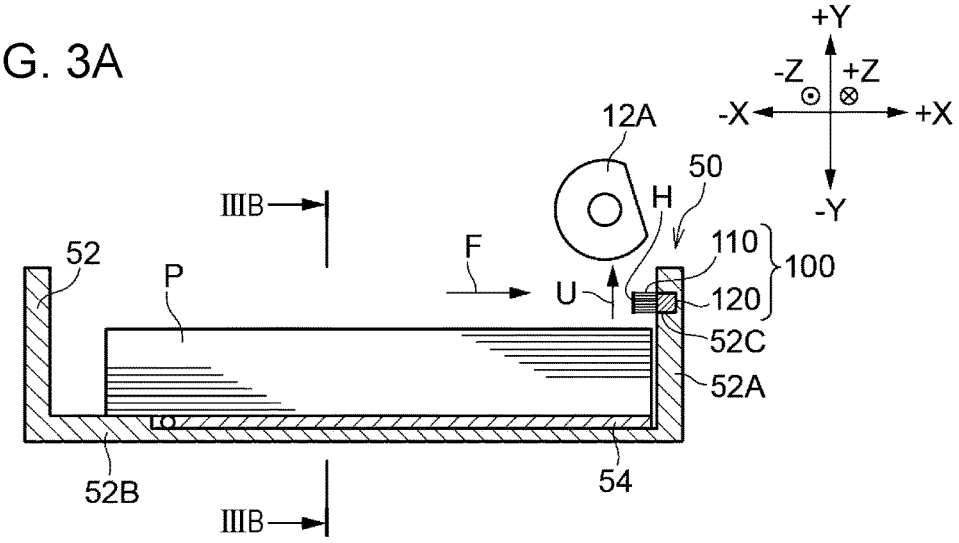
FIG. 3A is a front view (sectional view) of a containing unit according to the first exemplary embodiment.
Figure 3B:
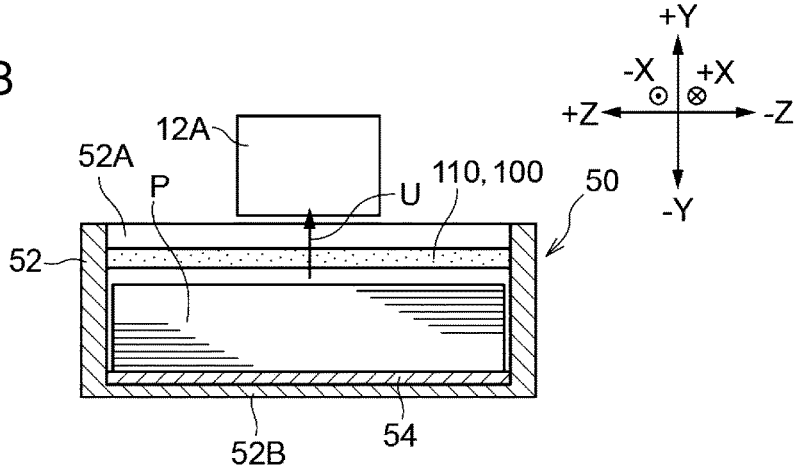
FIG. 3B is a side view taken along line IIIB-IIIB illustrated in FIG. 3A.

FIGS. 3A and 3B illustrate the containing unit 50. The containing unit 50 includes the containing member 52, a bottom plate 54, and a powder applying device 100. Here, the bottom plate 54 is an example of an ascending device.

As illustrated in FIG. 3A, the containing member 52 is a casing that has a recessed shape and is open at the top (+Y side). Recording media such as label sheets P contained in the containing member 52 are stacked one on top of another. The containing member 52 has wall portions 52A and a bottom portion 52B. The wall portions 52A are arranged in a rectangular frame shape in plan view. The bottom portion 52B closes a lower portion of the wall portion 52A. Furthermore, in the containing member 52, a groove portion 52C is formed on one of the wall portions 52A on the downstream side (+X side) of in the transport direction F. The groove portion 52C extending in the width direction of the label sheet P (Z direction) has a rectangular shape in section. The powder applying device 100 is provided in the groove portion 52C. The structure of the powder applying device 100 will be described later.

The bottom plate 54 is a plate-shaped member provided at the bottom portion 52B of the containing member 52. Here, the label sheets P contained in the containing member 52 are stacked one on top of another on an upper surface of the bottom plate 54. The bottom plate 54 has a fulcrum on the upstream side (−X side) in the transport direction F and an end portion on the downstream side (+X side) in the transport direction F (referred to as "distal end" hereafter) that is upwardly movable in an arrow U direction. The bottom plate 54 according to the present exemplary embodiment includes a drive device (not illustrated) which moves the distal end of the bottom plate 54 upward in the arrow U direction. Thus, the bottom plate 54 is inclined relative the bottom portion 52B. When the label sheets P contained in the inclined state are moved upward together with the bottom plate 54, the feed roller 12A is brought into contact with an uppermost one of the label sheets P in the containing member 52 (see FIG. 6A). Thus, the uppermost label sheet P is transported by the feed roller 12A toward the transport roller pair 12B. That is, the label sheet P is guided toward the transport path 12F in the transport direction F.

The bottom plate 54 may be moved upward by a spring member such as a coil spring instead of the drive device. In this case, the bottom plate 54 is moved downward along with removal (drawing) of the containing unit 50 from an apparatus body 10A of the image forming apparatus 10 and held in a lowered state. Furthermore, when the holding of the lowered state has been released due to mounting of the containing unit 50 in the apparatus body 10A, the bottom plate 54 is moved upward until the label sheet P is brought into contact with the feed roller 12A.

The powder applying device 100 is provided in the containing member 52 and has a function of applying powder H to the leading end of each of the label sheets P. The powder applying device 100 according to the present exemplary embodiment is provided in the width direction of the label sheet P (Z direction) in the groove portion 52C provided in the wall portion 52A of the containing member 52 (see FIG. 3B). The length of the powder applying device 100 in the width direction of the label sheet P (Z direction) is substantially equal to an inner width of the containing member 52 in the Z direction and equal to or larger than the width of the label sheet P, or more specifically, equal to or larger than the width of the tacky layer P2 (see FIG. 2A). This powder applying device 100 includes a contact portion 110 and a storing portion 120. The contact portion 110 is able to be brought into contact with the label sheet P. The powder H is stored in the storing portion 120.

Figure 4:
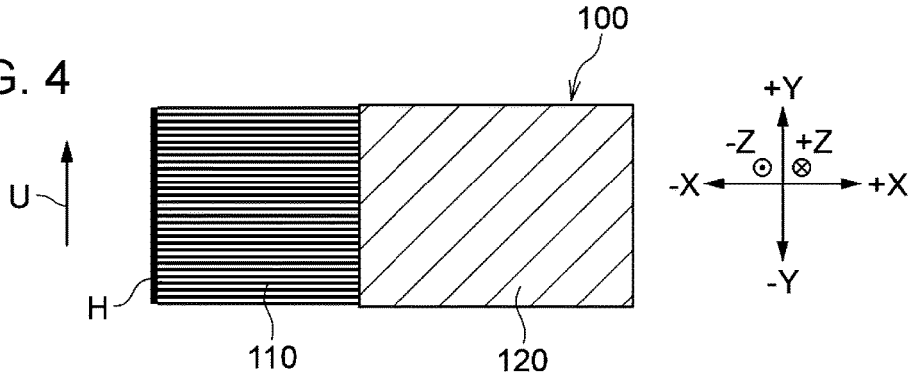
FIG. 4 is a structural view (sectional view) of a powder applying device of the containing unit according to the first exemplary embodiment.

As illustrated in FIG. 4, the storing portion 120 is an elongated member having a rectangular shape in section when seen in the width direction of the label sheet P. The storing portion 120 is formed of a sponge having an open cell structure and serving as a porous elastic body. Furthermore, the storing portion 120 is contained in the groove portion 52C.

The contact portion 110 is a brush-shaped member including fibers embedded in a surface of the storing portion 120 closer to the inner side (−X side) of the containing member 52. The powder H is held on a surface (on the −X side) of the contact portion 110. As illustrated in FIG. 3A, the contact portion 110 projects toward the −X side on the wall portion 52A on the +X side. That is, the contact portion 110 projects inward in the containing member 52. Additionally, the contact portion 110 projects to such a degree that the contact portion 110 is brought into contact with the leading end of the label sheet P even when the leading end of the label sheet P is separated from the wall portion 52A in the case where the contained label sheet P in the inclined state is moved upward together with the bottom plate 54. The type of the fibers included in the contact portion 110 may be, for example, a chemical fiber, an animal fiber, or a vegetable fiber. It is sufficient that the fibers of the contact portion 110 be able to be bent.

Examples of the powder H applied to the leading end of the label sheet P by the powder applying device 100 include, for example, silica, polymethyl methacrylate (PMMA), zinc stearate (ZnSt), calcium carbonate, and talc. The particle size (number-average particle size) of the powder H may be set to be, for example, from 0.5 to 14 μm. When the particle size of the powder H is smaller than 0.5 μm, the powder H is likely to be sunk into the tacky layer P2 of the label sheet P. Thus, it may be difficult to maintain the degree of suppression of the adherence of the glue. When the particle size of the powder H is larger than 14 μm, an initial degree of suppression of the adherence of the glue may tend to be smaller than a required degree of suppression. In addition to the above-described examples, the examples of the powder H may include a yellow (Y) toner and a clear toner.

Operations

As described above, the tacky layer P2 may extend outward past the surface material P1 in the label sheet P (see FIGS. 2A and 2B). That is, the glue may extend outward to an outer peripheral portion of the transfer surface S of the label sheet P. When the label sheet P in the above-described state enters the nip N, the glue may adhere to the transfer belt 32. In view of the above-described situation, the image forming apparatus 10 that includes the containing unit 50 according to the present exemplary embodiment may suppress adhering of the glue to the transfer belt 32 during image formation on the label sheet P. Operations according to the present exemplary embodiment are described below with reference to FIGS. 5A, 5B, 6A and 6B.

Figure 5A:
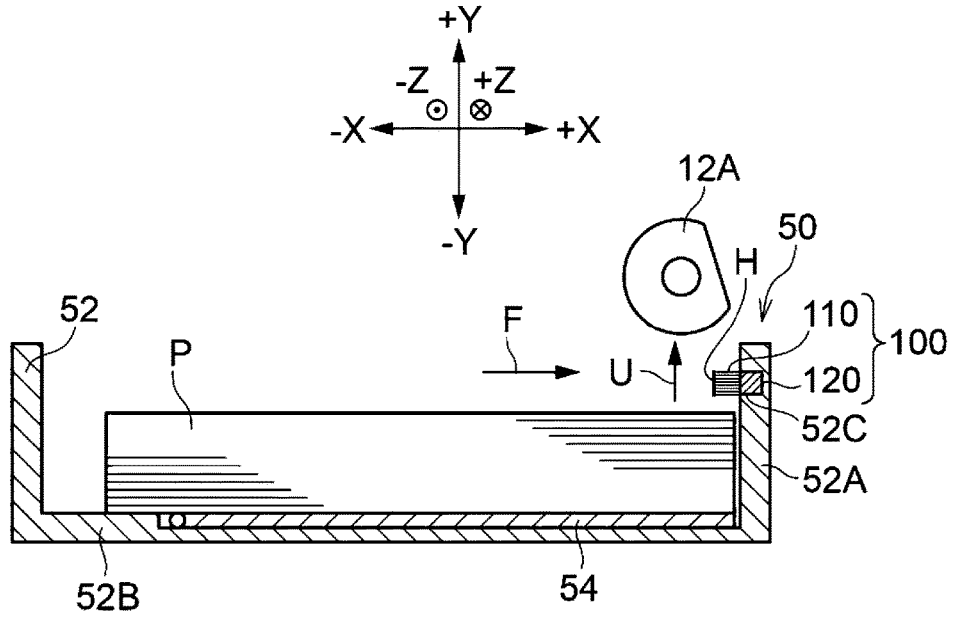
FIGS. 5A and 5B explain operation of the containing unit according to the first exemplary embodiment.

As illustrated in FIG. 5A, before the bottom plate 54 is moved upward, the label sheets P stacked one on top of another are contained in the containing member 52 in a horizontal state. At this time, the uppermost label sheet P is positioned below (−Y side) the powder applying device 100. That is, since the label sheets P are separated from the contact portion 110 of the powder applying device 100, the powder H does not adhere to the leading ends of the label sheets P. According to the present exemplary embodiment, even when a maximum number of the label sheets P are contained in the containing member 52, the uppermost label sheet P is positioned below (−Y side) the powder applying device 100.

Figure 5B:
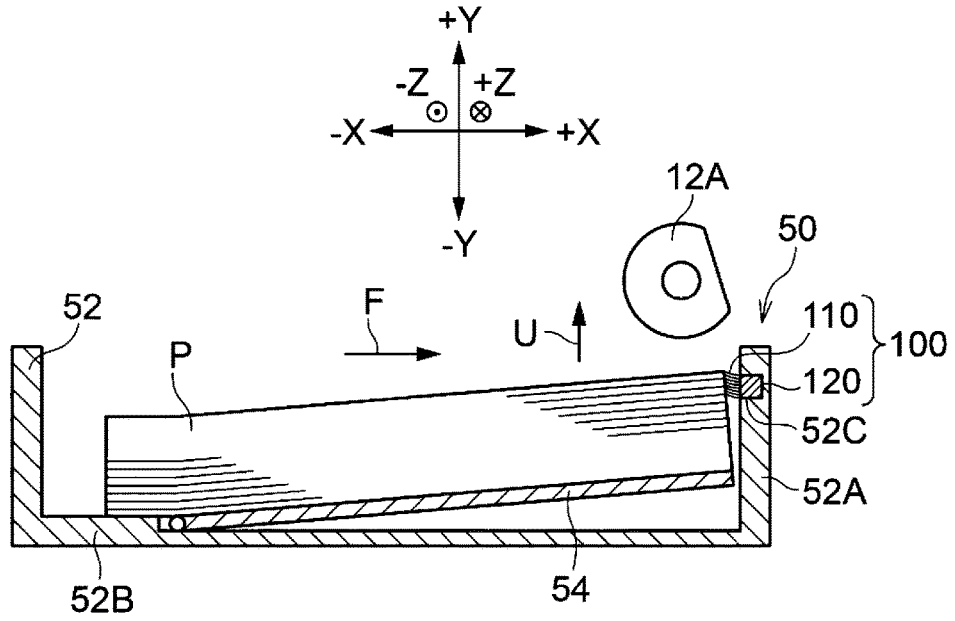

Next, as illustrated in FIG. 5B, when the distal end of the bottom plate 54 is moved upward in the arrow U direction, the leading ends of the label sheets P are moved upward together with the bottom plate 54 in the arrow U direction. Consequently, the label sheets P are sequentially brought into contact with the contact portion 110 from the uppermost label sheet P to the label sheets P below the uppermost label sheet P. This causes the powder H contained in the contact portion 110 or held on the surface of the contact portion 110 to adhere to the glue extending outward to the leading ends of the label sheets P. Here, since the contact portion 110 of the powder applying device 100 projects inward (−X side) in the containing member 52, the contact portion 110 is likely to be brought into contact with the leading ends of the label sheets P when the leading ends of the label sheets P are moved upward together with the bottom plate 54 in the arrow U direction. That is, according to the present exemplary embodiment, compared to a structure in which the contact portion 110 of the powder applying device 100 is disposed in the wall portion 52A, the powder H may easily adhere to the glue extending outward to the leading ends of the label sheets P. That is, exposure of the glue may be able to be further suppressed. As illustrated in FIG. 2B, in the case where the tacky layers P2 are disposed further to the trailing end sides than the release paper P3 at the leading ends of the label sheets P, the tacky layers P2 do not necessarily exposed from the stack of the label sheets P when the label sheets P are stacked one on top of another in the horizontal state in the containing member 52. However, with the contact portion 110 according to the present exemplary embodiment, the fibers included in the contact portion 110 reach the tacky layers P2 through gaps between sheets of the release paper P3. Thus, the powder H may adhere to the glue that extends past the leading ends of the label sheets P but is positioned inside the stack of the label sheets P.

Furthermore, the contact portion 110, which is a brush-shaped member, is bent at a portion where the contact portion 110 and the label sheets P are in contact with each other when the contact portion 110 is brought into contact with the leading ends of the label sheets P. This allows each of the label sheets P to be fed toward the feed roller 12A side (+Y side) while the movement of the label sheet P is not blocked by the contact portion 110. That is, according to the present exemplary embodiment, compared to a structure in which the contact portion 110 is not deformed or displaced, the likelihood of the label sheet P being caught by the contact portion 110 when the label sheet P is brought into contact with the contact portion 110 may be reduced. When the contact portion 110 is brought into contact with the label sheets P, the contact portion 110 is bent, and further, the storing portion 120 is elastically deformed. As a result, the powder H contained in the storing portion 120 is supplied to the contact portion 110. That is, the storing portion 120 according to the present exemplary embodiment is able to supply the powder H when the contact portion 110 is a brush-shaped member. According to the present exemplary embodiment, compared to a structure that is not provided with the storing portion 120, shortage in supply of the powder H may be suppressed.

Figure 6A:
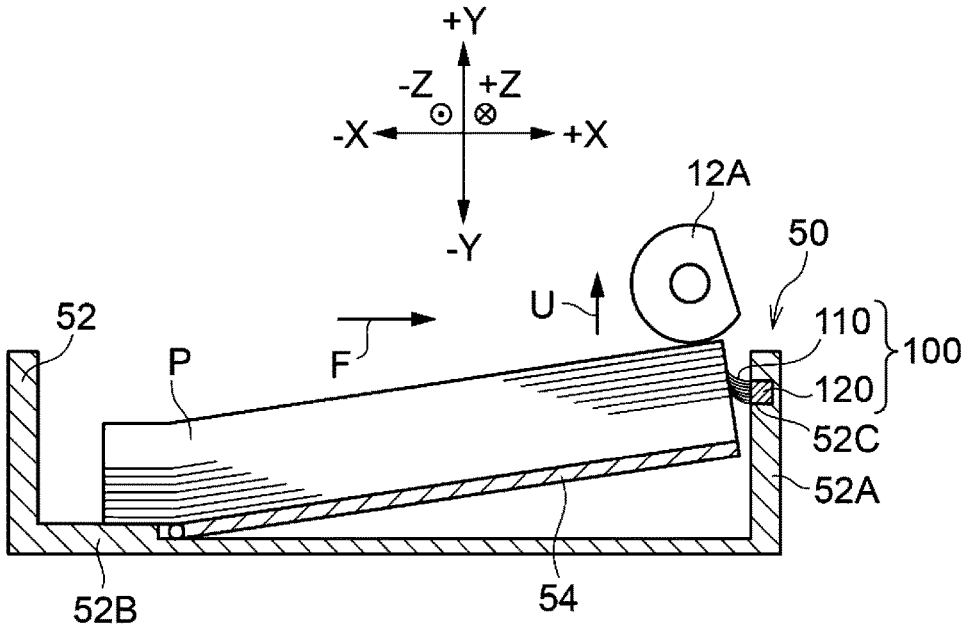
FIGS. 6A and 6B explain the operation of the containing unit according to the first exemplary embodiment.
Figure 6B:
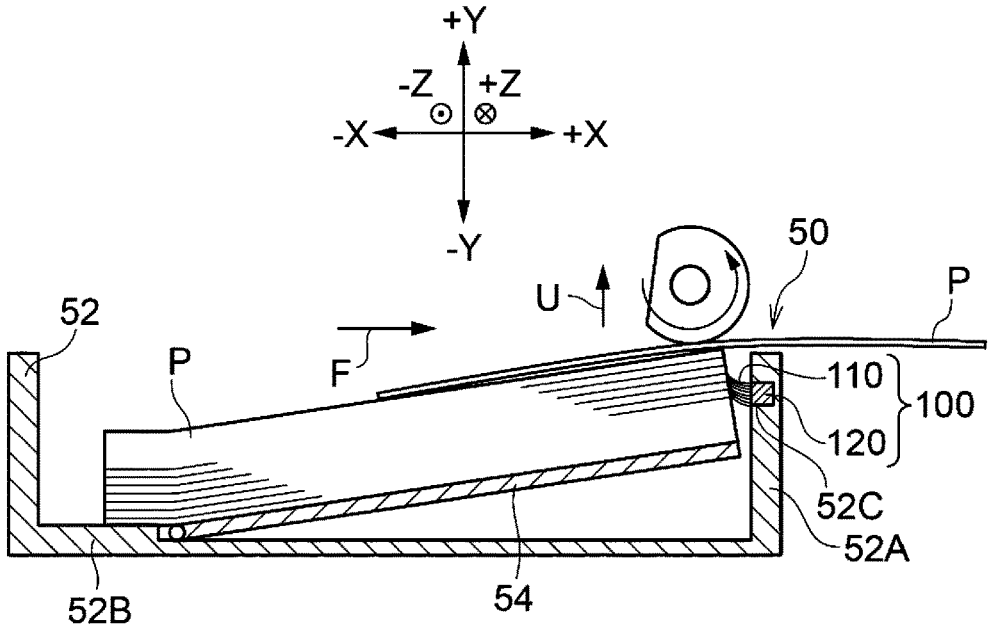

When the leading ends of the label sheets P are further moved upward in the arrow U direction, as illustrated in FIG. 6A, the feed roller 12A is brought into contact with the uppermost label sheet P in the containing member 52. Thus, as illustrated in FIG. 6B, the uppermost label sheet P is transported toward the transport roller pair 12B when the feed roller 12A is rotated. That is, the label sheet P is guided toward the transport path 12F in the transport direction F.

Thus, with the containing unit 50 according to the present exemplary embodiment, when the label sheet P is used, the following features may be obtained compared to the structure with which the powder H is not applied to the leading end of the label sheet P. That is, according to the present exemplary embodiment, due to the upward movement of the label sheet P along with the upward movement of the bottom plate 54, the powder H is able to be applied to the leading end of the label sheet P. That is, since the powder H is able to adhere to the glue extending outward to the leading end of the label sheet P, exposure of the glue at the leading end of the label sheet P may be suppressed. This may suppress adhering of the glue to the transfer belt 32, and accordingly, may suppress image defects. Furthermore, since adhering of the glue to portions of the transport path 12F is suppressed, transport failure may be suppressed. In order to check whether or not the exposure of the glue is suppressed at the leading end of the label sheet P, it is sufficient to check, for example, whether or not an adhering force of the glue exposed at the leading end of the label sheet P is reduced.

Furthermore, as illustrated in FIGS. 5B, 6A, and 6B, the contact portion 110 is brought into contact with the leading ends of the label sheets P that are stacked one on top of another. Here, the powder H may adhere to the transfer surface S at the leading end of the uppermost label sheet P that is to be brought into contact with the contact portion 110 first. However, the powder H is unlikely to adhere to the transfer surfaces S of the label sheets P below the uppermost label sheet P. Also with the uppermost label sheet P, when the amount of projection of the contact portion 110 inward (−X side) in the containing member 52 is equal to or smaller than the length of the margin M on the leading end side of the label sheet P, adhering of the powder H to the image forming region A where the images are formed may be suppressed.

Second Exemplary Embodiment

The powder applying device according to a second exemplary embodiment is differently structured from that of the first exemplary embodiment. The difference between the first exemplary embodiment and the second exemplary embodiment will be described. The same elements as those of the first exemplary embodiment are denoted by the same reference signs.

Figure 7:
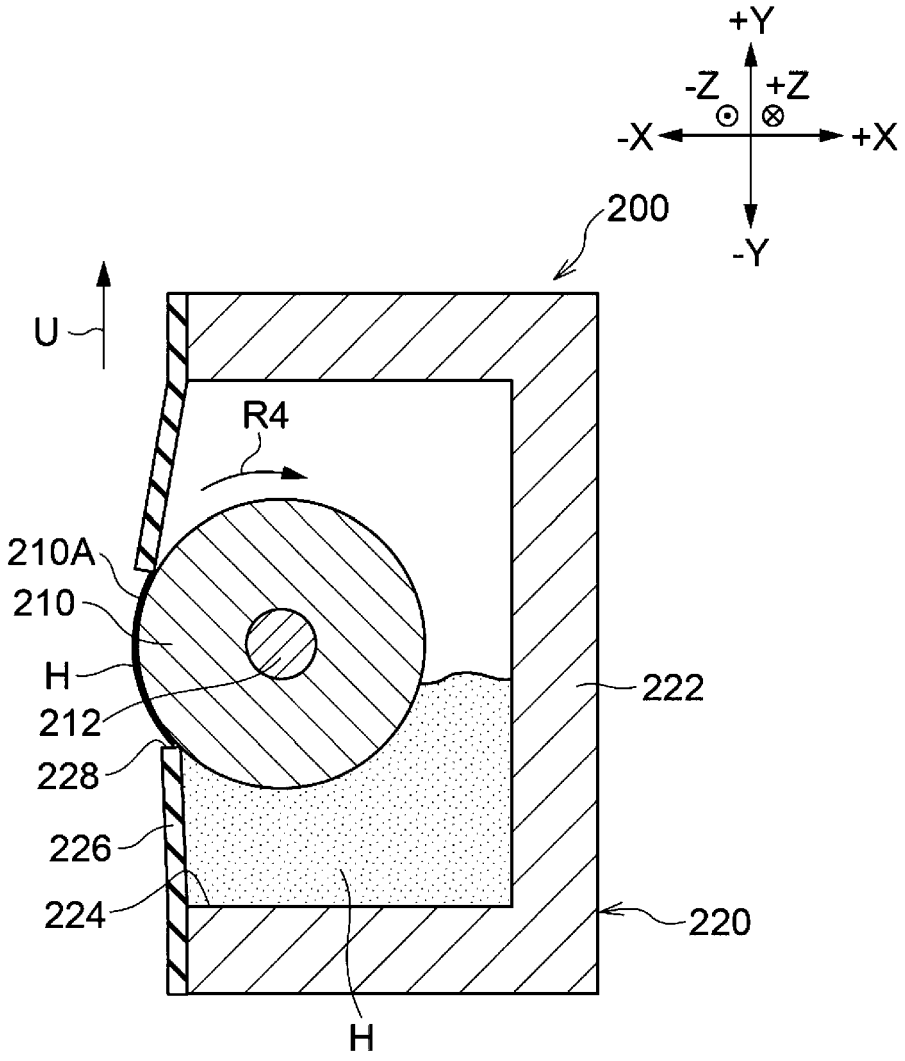
FIG. 7 is a structural view (sectional view) of a powder applying device of a containing unit according to a second exemplary embodiment.

As illustrated in FIG. 7, a powder applying device 200 according to the second exemplary embodiment is provided in the width direction of the label sheet P (Z direction) in the groove portion 52C of the containing member 52. This powder applying device 200 includes a contact portion 210 and a storing portion 220. The contact portion 210 has a cylindrical shape and is rotatable about the axis extending in the width direction of the label sheet P (Z direction). The powder H is stored in the storing portion 220. The contact portion 210 has a length in the width direction of the label sheet P (Z direction) that is, in the Z direction, equal to an inner width of the containing member 52 and equal to or larger than width of the label sheet P. A shaft 212 is inserted through a central portion of the contact portion 210. End portions of the shaft 212 in the width direction of the label sheet P (on the +Z side and the −Z side) are rotatably supported by wall portions of a container 222 of the storing portion 220. Part of the cylindrical surface 210A of the contact portion 210 on the −X side is exposed in the containing member 52. The cylindrical surface 210A serves as an example of a contact surface. The contact portion 210 projects to such a degree that the contact portion 210 is brought into contact with the leading end of the label sheet P even when the leading end of the label sheet P is separated from the wall portion 52A in the case where the contained label sheet P in the inclined state is moved upward together with the bottom plate 54. Although the contact portion 210 is formed of a sponge having an open cell structure and serving as a porous elastic body according to the present exemplary embodiment, this is not limiting as long as the powder H is able to be held and able to be applied to the leading end of the label sheet P at the cylindrical surface 210A. For example, the contact portion 210 may be formed of brush-shaped fiber member.

The storing portion 220 has an opening 224 on the inner side of the containing member 52 (−X side) and the container 222 having a box shape elongated in the width direction of the label sheet P (Z direction). This storing portion 220 is contained in the groove portion 52C of the containing member 52. Furthermore, the contact portion 210 is contained in the container 222. Furthermore, a cover portion 226 is provided so as to cover the opening 224. The cover portion 226 has a gap 228 at its central portion in the Y direction. The contact portion 210 is disposed so as to close the gap 228 from which the cylindrical surface 210A of the contact portion 210 is exposed. In other words, the cover portion 226 covers the contact portion 210 so that the cylindrical surface 210A is exposed from the gap 228. The cover portion 226 is an elastic plate member, and a peripheral portion around the gap 228 is pressed against the cylindrical surface 210A.

Here, in the storing portion 220, the contact portion 210 is contained in a space defined by the container 222 and the cover portion 226, and the powder H is stored such that the powder H is in contact with the contact portion 210 (cylindrical surface 210A). The powder H is held on the cylindrical surface 210A of the contact portion 210 exposed from the gap 228.

Operation of the powder applying device 200 according to the second exemplary embodiment is as follows. That is, as illustrated in FIG. 5B, when the distal end of the bottom plate 54 is moved upward in the arrow U direction, the leading ends of the label sheets P are brought into contact with the powder applying device 200. Specifically, the leading ends of the label sheets P are brought into contact with the cylindrical surface 210A of the contact portion 210 of the powder applying device 200 exposed in the containing member 52. This may cause the powder H held on the cylindrical surface 210A to adhere to the glue extending outward to the leading ends of the label sheets P. Furthermore, the contact portion 210 is rotated in the arrow U direction (an arrow R4 direction illustrated in FIG. 7) when the leading ends of the label sheets P are brought into contact with the contact portion 210. That is, according to the present exemplary embodiment, compared to a structure in which the contact portion 210 is not deformed or displaced, the likelihood of the label sheet P being caught by the powder applying device 200 when the label sheet P is brought into contact with the powder applying device 200 may be reduced. As illustrated in FIG. 7, as a result of the rotation of the contact portion 210 in the arrow R4 direction, the powder H in the storing portion 220 is picked up by the contact portion 210 and a new portion of the cylindrical surface 210A to which the powder H adheres appears in the gap 228. That is, the storing portion 220 is able to supply the powder H when the contact portion 210 is a rotatable cylindrical body. According to the present exemplary embodiment, compared to a structure that is not provided with the storing portion 220, shortage in supply of the powder H may be suppressed.

As illustrated in FIG. 2B, in the case where the tacky layers P2 are disposed further to the trailing end sides than the release paper P3 at the leading ends of the label sheets P, the tacky layers P2 do not necessarily exposed from the stack of the label sheets P when the label sheets P are stacked one on top of another in the horizontal state in the containing member 52. However, with the contact portion 210 according to the present exemplary embodiment, a layer of the powder H is formed on the cylindrical surface 210A. Thus, the powder H may adhere to the glue that extends past the leading ends of the label sheets P but is positioned inside the stack of the label sheets P. Furthermore, when the contact portion 210 is formed of a fiber member, the fibers included in the contact portion 210 reach the tacky layers P2 through gaps between sheets of the release paper P3. Thus, the powder H may adhere to the glue that extends past the leading ends of the label sheets P but is positioned inside the stack of the label sheets P.

Third Exemplary Embodiment

A support structure of the powder applying device according to a third exemplary embodiment is different from that of the first exemplary embodiment. The difference between the first exemplary embodiment and the third exemplary embodiment will be described. The same elements as those of the first exemplary embodiment are denoted by the same reference signs.

Figure 8:
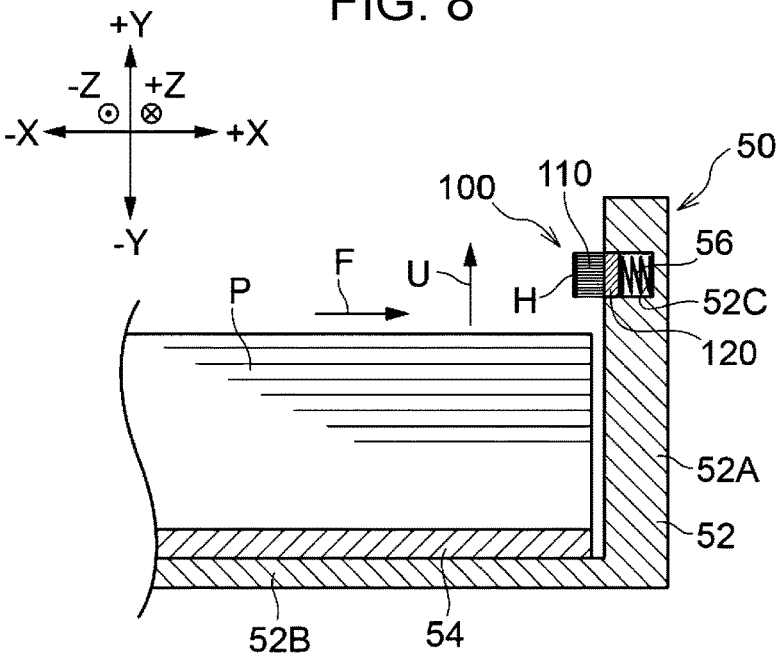
FIG. 8 is a front view (sectional view) of a containing unit according to a third exemplary embodiment.

As illustrated in FIG. 8, the powder applying device 100 according to the third exemplary embodiment is supported by coil springs 56. Each of the coil springs 56 serves as an elastic body that is an example of a pressure member. These coil springs 56 have a function of pressing the powder applying device 100 toward the label sheet P side. The plural coil springs 56 that are able to extend and contract in the X direction are arranged in the width direction of the label sheet P (Z direction) in the groove portion 52C of the containing member 52. Furthermore, the storing portion 120 is slidably contained in the groove portion 52C. In this way, the plural coil springs 56 are interposed between a bottom portion of the groove portion 52C (surface on the −X side) and a bottom surface of the storing portion 120 (surface on the +X side). The powder applying device 100 including the storing portion 120 is prevented from dropping from the groove portion 52C by a stopper (not illustrated; for example, a structure in which a claw member projecting from the storing portion 120 is fitted into a step portion provided in the groove portion 52C).

Operation of the powder applying device 100 according to the third exemplary embodiment is as follows. That is, as illustrated in FIG. 5B, when the distal end of the bottom plate 54 is moved upward in the arrow U direction, the leading ends of the label sheets P are brought into contact with the contact portion 110. At this time, the powder applying device 100 including the contact portion 110 is pressed by the stack of the label sheets P, thereby the powder applying device 100 is moved toward the inside of the groove portion 52C (+X side) resisting elastic forces of the coil springs 56. Thus, although the contact portion 110 is pressed so as to be retracted to the groove portion 52C side due to contact with the label sheets P, the contact portion 110 is pressed against the leading ends of the label sheets P due to the elastic forces of the coil springs 56. Thus, according to the present exemplary embodiment, compared to a structure in which the powder applying device 100 is not supported by the coil springs 56, the powder H may easily adhere to the glue extending outward to the leading ends of the label sheets P. That is, exposure of the glue may be able to be further suppressed.

Here, when the number of the label sheets P contained in the containing member 52 reduces, that is, the thickness of the stack of the label sheets P becomes smaller than the height of the contact portion 110 (length in the Y direction), the label sheets P are more easily deformed than the contact portion 110. Furthermore, the likelihood of the leading ends of the label sheets P being caught by the contact portion 110 increases. Accordingly, when the number of the label sheets P contained in the containing member 52 reduces, there may be transport failure of the label sheets P such as paper jamming due to damage to the label sheets P. In order to address this, the powder applying device 100 including the contact portion 110 is movable in the X direction according to the present exemplary embodiment. Thus, even when the number of the label sheets P contained in the containing member 52 reduces, the powder applying device 100 is pressed so as to be retracted to the groove portion 52C side, thereby allowing the label sheets P to be smoothly fed toward the feed roller 12A side (+Y side).

Although the coil springs 56 are used as examples of the pressure member according to the present exemplary embodiment, this is not limiting. Instead, a plate spring may be provided in the width direction of the label sheet P (Z direction). Furthermore, since the powder applying device 100 itself is movable in the X direction according to the present exemplary embodiment, the contact portion 110 is not necessarily formed of a brush-shaped member including fibers. For example, the contact portion 110 may be formed of a sponge having an open cell structure and serving as a porous elastic body. Furthermore, the structure according to the present exemplary embodiment may be used for the powder applying device 200 according to the second exemplary embodiment.

Fourth Exemplary Embodiment

The disposition of the powder applying device according to a fourth exemplary embodiment is different from that of the first exemplary embodiment. The difference between the first exemplary embodiment and the fourth exemplary embodiment will be described. The same elements as those of the first exemplary embodiment are denoted by the same reference signs.

Figure 9:
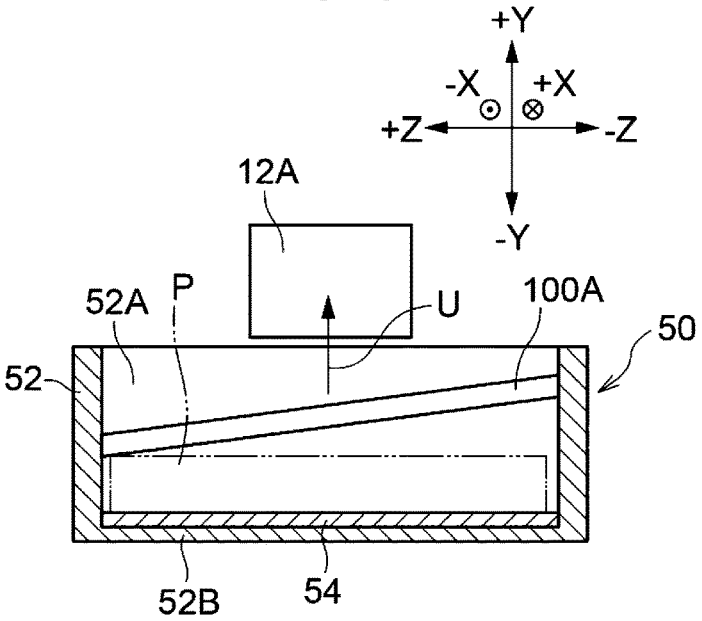
FIG. 9 is a side view (sectional view) of a containing unit according to a fourth exemplary embodiment.

As illustrated in FIG. 9, a powder applying device 100A according to the fourth exemplary embodiment includes the contact portion 110 and the storing portion 120 as is the case with the powder applying device 100 according to the first exemplary embodiment. Here, as illustrated in FIG. 3B, the powder applying device 100 according to the first exemplary embodiment is horizontally provided in the width direction of the label sheet P (Z direction). In contrast, as illustrated in FIG. 9, the powder applying device 100A according to the fourth exemplary embodiment is provided such that an end portion of the powder applying device 100A on the +Z side is disposed at a lower position (−Y side) than the position of an end portion of the powder applying device 100A on the −Z side. Additionally, the powder applying device 100A is provided in a groove portion that is formed such that, relative to the wall portion 52A of the containing member 52, an end portion of the groove portion on the +Z side is disposed at a lower position (−Y side) than the position of an end portion of the groove portion on the −Z side. According to the present exemplary embodiment, even when a maximum number of the label sheets P are contained in the containing member 52, the uppermost label sheet P is positioned below (−Y side) the powder applying device 100A.

The operation and the features of the powder applying device 100A according to the present exemplary embodiment are as follows. That is, as illustrated in FIG. 5B, when the distal end of the bottom plate 54 is moved upward in the arrow U direction, the leading ends of the label sheets P start being brought into contact with the contact portion 110 from the +Z side. This contact position moves toward the −Z side as the distal end of the bottom plate 54 is moved upward. That is, when the leading ends of the label sheets P are brought into contact with the contact portion 110, the label sheets P are brought into contact continuously in the width direction of the label sheet P (Z direction) instead of being brought into contact entirely in the width direction at a time. Accordingly, compared to the case where the powder applying device is horizontally provided, resistance generated when the powder H is applied may be suppressed.

Notes

Although the bottom plate 54 is moved upward so as to be inclined relative to the bottom portion 52B in the containing unit 50 according to the above-described exemplary embodiments, this is not limiting. The bottom plate 54 may be moved upward while being parallel to the bottom portion 52B.

Furthermore, although the containing unit 50 contained in the apparatus body 10A serves as an example of the sheet containing system according to the exemplary embodiments, this is not limiting. The following structure may be used. That is, a feed unit mounted outside the apparatus body 10A serves as an example of the sheet containing system, and the powder applying device 100 is provided in this feed unit.

Although the toner images G of the colors developed by the respective image forming units 20 are transferred onto the label sheet P through the transfer belt 32 in the above-described exemplary embodiments, this is not limiting. The toner images G may be directly transferred onto the label sheet P. Furthermore, although the image forming apparatus is for forming toner images of multiple colors according to the above-described exemplary embodiments, this is not limiting. Techniques described herein may be used for an image forming apparatus for forming toner images of a single color (for example, black (K)). In the above-described cases, the label sheet P is transported toward the photosensitive drum 22 serving as an example of the image holding body.

For the exemplary embodiments, a switching device may be provided. With this switching device, whether or not to use the powder applying device 100 or 200 is switched in accordance with the type of the recording medium. As the switching device, for example, a cover (shutter) may be provided on a surface of the contact portion 110 or 210 on the inner side of the containing member 52. Alternatively, the powder applying device 100 or 200 may be removed and an elongated member (dummy) formed of resin may be mounted in the groove portion 52C. With the switching device, application of the powder H is able to be stopped when recording paper used as the recording medium is, for example, plain paper. That is, the containing unit 50 (containing member 52) is also usable for other types of sheets such as plain paper instead of being dedicated to the label sheets P.

For the exemplary embodiments, the powder applying device 100 or 200 may be irreplaceable. In this case, the storing portion 120 or 220 has such a capacity that the powder H is not exhausted in the life of the apparatus. Instead, for the exemplary embodiments, the powder applying device 100 or 200 may be replaceable. In this case, only the storing portion 120 may be replaced with a new storing portion 120 for the powder applying device 100 according to the first and third exemplary embodiments and for the powder applying device 100A according to the fourth exemplary embodiments, or the powder applying device 100 or 100A itself may be replaced with a new powder applying device 100 or 100A. Furthermore, regarding the powder applying device 200 according to the second exemplary embodiment, the storing portion 220 may be replenished with the powder H, or the powder applying device 200 itself may be replaced with a new powder applying device 200.

Although the sheet onto which the toner images G are transferred is the label sheet P that includes the tacky layer P2 to which the glue is applied according to the exemplary embodiments, the sheet usable with the techniques herein is not limited to the label sheet P. For example, the techniques herein may be used for coated paper formed by coating the surface of plain paper with resin or the like. Also with the coated paper, image defects may occur or the cleaning performance may be adversely affected when the resin on the surface of the coated paper is removed and adheres to the transfer belt 32. Accordingly, by causing the powder H to adhere to the leading end of the coated paper in the transport direction F, adhering of the resin on the surface of the coated paper to the transfer belt 32 may be suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet containing system comprising:

a containing member that has a wall portion and that is configured to contain a sheet;

a feed device configured to feed the sheet to an outside of the containing member;

an ascending device configured to move up the sheet contained in the containing member toward the feed device; and a powder applying device that is provided in the wall portion disposed on a downstream side in the containing member in a transport direction of the sheet and that is configured to apply powder to an end portion of the sheet on the downstream side in the transport direction of the sheet.

2. The sheet containing system according to claim 1, further comprising:

a storing portion configured to store the powder supplied to the powder applying device.

3. The sheet containing system according to claim 2, wherein the powder applying device includes:

a contact portion that is provided so as to be able to be brought into contact with the sheet in a width direction of the sheet and that is a brush-shaped member.

4. The sheet containing system according to claim 3, wherein the storing portion is a porous elastic body connected to the contact portion.

5. The sheet containing system according to claim 2, wherein the powder applying device includes:

a contact portion that is rotatable about an axis extending in a width direction of the sheet and that is a cylindrical body able to be brought into contact with the sheet.

6. The sheet containing system according to claim 5, wherein the storing portion includes:

a container configured to store the powder such that the powder is in contact with the contact portion.

7. The sheet containing system according to claim 1, wherein the powder applying device includes:

a contact portion that is provided so as to be able to be brought into contact with the sheet in a width direction of the sheet and that is a brush-shaped member.

8. The sheet containing system according to claim 1, wherein the powder applying device includes:

a contact portion that is rotatable about an axis extending in a width direction of the sheet and that is a cylindrical body able to be brought into contact with the sheet.

9. The sheet containing system according to claim 1, wherein the powder applying device projects inward from the wall portion in the containing member.

10. The sheet containing system according to claim 9, further comprising:

a pressure member that is able to press the powder applying device toward a sheet side and that supports the powder applying device.

11. An image forming apparatus comprising:

an image forming section configured to transfer onto the sheet a toner image formed by developing an electrostatic latent image; and the sheet containing system according to claim 1, wherein the image forming apparatus has a transport path through which the sheet may be transported from the sheet containing system toward the image forming section.

12. A sheet containing system comprising:

a containing member that has a wall portion and that is configured to contain a sheet;

means for feeding configured to feed the sheet to an outside of the containing member;

an ascending device configured to move up the sheet contained in the containing member toward the means for feeding; and means for applying powder that is provided in the wall portion disposed on a downstream side in the containing member in a transport direction of the sheet and that is configured to apply powder to an end portion of the sheet on the downstream side in the transport direction of the sheet.

* * * * *